United States Patent [19]

Ramsier

[11] Patent Number: 5,027,452

[45] Date of Patent: Jul. 2, 1991

[54] LOAD REPOSITIONING DEVICE

[76] Inventor: Edward R. Ramsier, 1174 Madison Ave., Wooster, Ohio 44691

[21] Appl. No.: 441,377

[22] Filed: Nov. 27, 1989

[51] Int. Cl.[5] ..... A47C 17/40

[52] U.S. Cl. ..... 5/136; 5/164.1; 267/158

[58] Field of Search ..... 5/164 R, 164 B, 164 C, 5/164 D, 164 E, 136; 267/158

[56] References Cited

U.S. PATENT DOCUMENTS

| | | | |
|---|---|---|---|
| 256,449 | 4/1882 | Steinbrenner | 5/164 D |
| 3,550,167 | 12/1970 | Bennett | 5/164 R |
| 4,058,861 | 11/1977 | Kruse | 5/164 R |
| 4,313,620 | 2/1982 | Posnikoff | 267/158 |
| 4,901,382 | 2/1990 | Spitz | 5/136 |

FOREIGN PATENT DOCUMENTS

| | | | |
|---|---|---|---|
| 1146916 | 11/1957 | France | 5/164 |

*Primary Examiner*—Alexander Grosz

*Attorney, Agent, or Firm*—Oldham & Oldham Company

[57] ABSTRACT

A combination leaf spring hinge assembly suitable for use in retractable beds or other retractable apparatus such as work benches.

The leaf spring hinge assembly includes a base and a moving slat connected by a pivot means and a combination leaf spring adapted to engage a roller chain attached to a chain sprocket attached to the moving slat. The combination leaf spring hinge assembly is designed to efficiently transfer energy from the deflected load to the springs and back again upon load repositioning.

16 Claims, 4 Drawing Sheets

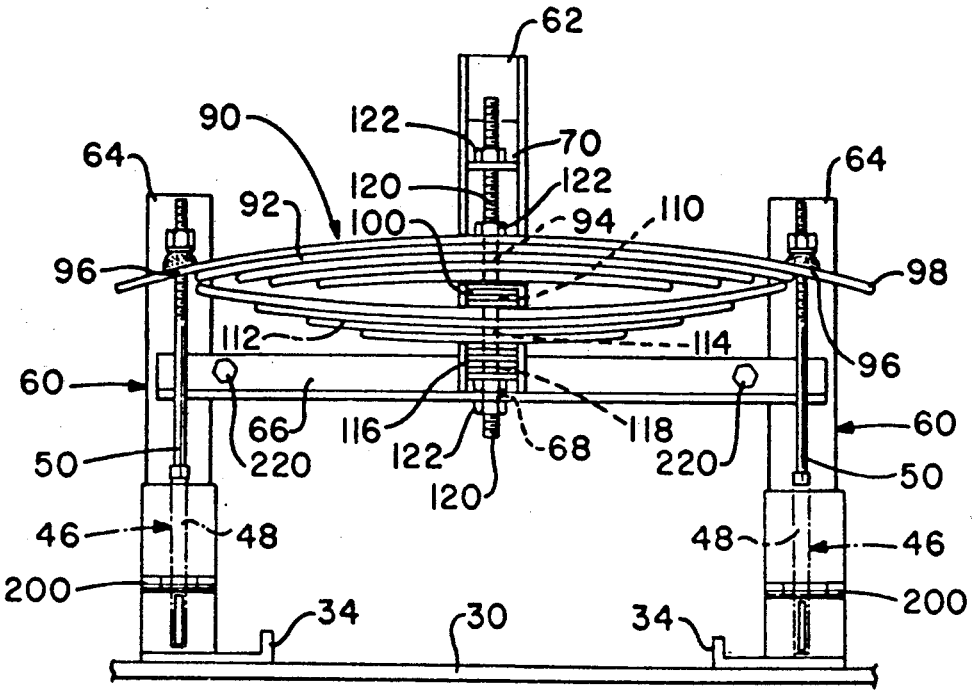
FIG.-4
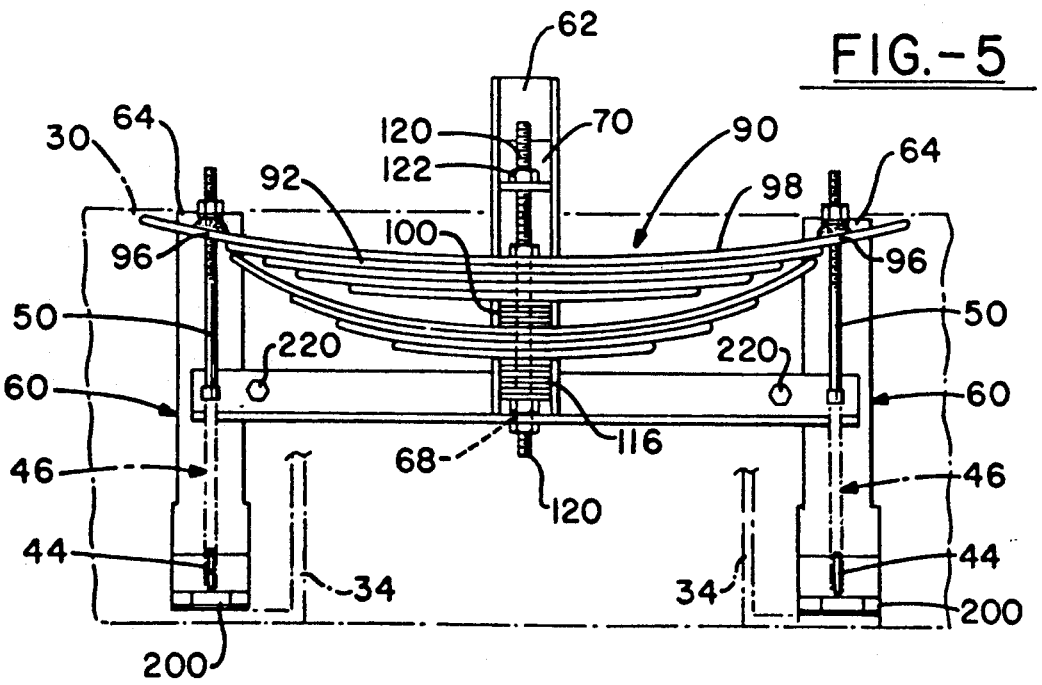

LOAD REPOSITIONING DEVICE

TECHNICAL FIELD

This invention describes the design of a leaf spring, lever and hinge assembly and the use of this assembly in the design of retractable load apparatus and in particular this invention relates to the design of retractable beds using a leaf spring, lever and hinge assembly.

BACKGROUND ART

Retractable mechanisms have been in use for many years for such applications as retractable beds. The retraction mechanisms were supported by a floor assembly and relied on counterbalanced weights and pulley systems to affect load repositioning.

More recently, Brie et al. in U.S. Pat. No. 3,999,245 disclosed a retraction assembly usable for retractable beds and other retractable apparatus which was anchored to the floor or other appropriate support and employed a coil spring and hinge mechanism to provide pivoting of a load such as a bed between a vertical position and a horizontal position.

Coil springs have several limitations and shortcomings. They are built specifically for a given load range and, thus, are not easily modified to accommodate loads significantly heavier or lighter than the spring load rating. In order to handle significantly heavier or lighter loads, a coil spring assembly would require a complete upgrade of the coil spring and its housing. Coil springs also begin to wear and lose part of their original properties such as spring constant, which cannot easily be adjusted. Thus, as a coil spring assembly weakens due to normal use, and no easy method exists to readily compensate for the loss of the original spring properties.

Thus, it appears desirable to design a retraction apparatus for load repositioning which would provide for greater load flexibility and durability. It also appears to be desirable to provide a retraction apparatus that can be easily adjusted with respect to load capacity and with respect to age induced losses of the original spring characteristics. It also appears to be desirable to provide a retraction apparatus which can be incorporated into a retractable bed and which will allow efficient repositioning of an attached load from vertical to horizontal positions and back again.

DISCLOSURE OF THE INVENTION

An object of this invention is to provide a leaf spring, lever and hinge assembly in which a portion of the energy required to lower a load is stored in the leaf spring, allowing for easy restoration of the load to an upright, or vertical position.

A further object of this invention is to provide a lever means adapted to engage a leaf spring assembly in order to transfer the energy imparted by a person lowering the load into the spring assembly. The lever means provides the necessary amplified force to minimize the work needed to lower the load to a horizontal position.

It is a further object of this invention to provide a load repositioning device having a novel retraction apparatus based on an adjustable leaf spring or cooperatively paired leaf springs, to provide various alternative advantages.

A further object of this invention is to provide a larger leaf spring paired with a cooperatively positioned smaller leaf spring, wherein the larger leaf spring stores energy during load lowering and where the smaller spring receives an allotment of energy only in the latter portions of lowering and therefore provides added energy during the early portions of load restoration.

A further object of this invention is to provide a hinged attachment of the load to a spring support structure attached to a base to allow pivotal load repositioning.

Another object of this invention is to provide a plurality of leaf spring, hinge and lever assemblages mounted on a single base. The plurality of either single or cooperatively paired leaf spring, hinge and lever assemblages is required when extremely heavy or large loads are being repositioned.

A still further object of this invention is to provide retractable beds utilizing the novel leaf spring, lever and hinge assemblies or a plurality of the novel leaf spring, lever and hinge assemblies of this invention.

The novel load repositioning device comprises a load frame, such as a bed frame, having a plurality of lever means attached to the frame. A base anchored to a base support structure such as a floor or a wall insert by base anchoring members acts to support the frame and load repositioning device. The load repositioning device includes a spring support structure attached to the base, along with a spring assembly attached to the support structure, and a plurality of hinges adapted to couple the lever means and the spring support structure at a plurality of locations on the spring support structure to allow load pivoting relative to the base. A plurality of adjustable load supports are affixed to the spring support structure and are adapted to engage the frame when it is in its vertical position so as to transfer the weight of the load to the base. Although the novel load repositioning device as described above speaks to a base, a base is not always required, especially in those applications where the mechanism is to be installed as an integral part of a structure such as a mobile home or other prefabricated structure.

The lever means may comprise a sprocket attached to the frame and roller chain assembly adapted to engage the sprocket and to engage the spring assembly by means of a mounting rod.

In the preferred embodiment, the spring support structure comprises a center member, along with two side members substantially parallel to the center member. A cross member is positioned substantially perpendicular to the center and side members, and a spring engaging rod mount is attached to the center member near an end opposite the location where said center member and cross member intersect, said cross member is adapted to engage said side members and center member such that the entire assemblage operates as one piece.

The spring assembly comprises at least one leaf spring being supported at a center portion thereof by means of a spring mounting and adjustment rod adapted to maintain the position of the springs relative to the support structure. The leaf springs can be made from a variety of standard structural building materials, including but not restricted to, metal composites, fiberglass composites, graphite composites and other similar materials.

In the case of a spring assembly which has only one leaf spring, the largest leaf of said spring will have apertures at each end which are adapted to engage the lever means. This engagement allows part of the energy needed to reposition the load to be stored in the spring assembly.

In the case of two or more leaf springs, a cooperative construction comprising successively smaller springs arranged together may be utilized to accommodate larger loads. This type of arrangement may be referred to as cooperatively paired leaf springs. One spring assembly may then be adapted to engage the lever means and to coact with the other spring assembly which allows part of the energy needed to reposition the load to be stored in the cooperating spring assembly.

The novel load repositioning device can be incorporated into a retractable bed in which the load frame would comprise a headboard, a head rest, and a frame support surrounding a panel which adds to the decorative aspect of the bed when the bed is in an upright or vertical position as well as serving as a support for the lever means.

The use of leaf springs in the invention facilitates adjusting the spring constant of the springs as well as the ease of changing the spring load capacity. Leaf springs consist of pretensioned metal plates. The spring capacity can be changed by simply changing the number of plates in the spring. One can easily change spring capacity by either adding or removing spring plates. Spring tensioning is adjusted simply by changing the relative position of the springs on the spring mounting rods or by adjusting the position of spacers and/or the spacer thickness near a center portion of the spring. The adjustability of leaf springs gives them much more flexibility in areas of operation where large changes in load capacity and load requirements are necessary. Leaf springs can also be adjusted to compensate for loss of original spring capacity due to aging.

For exceptionally heavy loads, a plurality of load repositioning devices can be used. The ability to increase the number of spring assemblies to accommodate particularly heavy loads or particularly larger loads, makes the load repositioning device of the present invention particularly useful in applications such as retractable king size beds and/or heavy retractable machinery bench mechanisms. Of course the use of multiple assemblies could result in a reduction in the actual size of each assembly. The ability to split the load capacity among multiple spring assemblies on the same support platen greatly increases the load range under which this type of apparatus could operate. Similarly, the ability to adjust the leaf spring capacity and tension yield greater flexibility the use of single spring or cooperatively paired spring assemblies.

It is understood that when the words "attached" or "attachment" are referenced in this present application, these terms were synonymous with standard means for attaching one object to another, such as welding, brazing, bolting, and other standard methods.

BRIEF DESCRIPTION OF THE DRAWINGS

The objects and advantages of the invention will be more fully understood with reference to the following detailed description in conjunction with the drawings herein:

FIGS. 4 and 5 show close up, top views of the load repositioning device shown as a sequence from the horizontal or down position to a vertical or upright position, with obstructing elements removed;

DETAILED DESCRIPTION OF THE INVENTION

Figure 1:
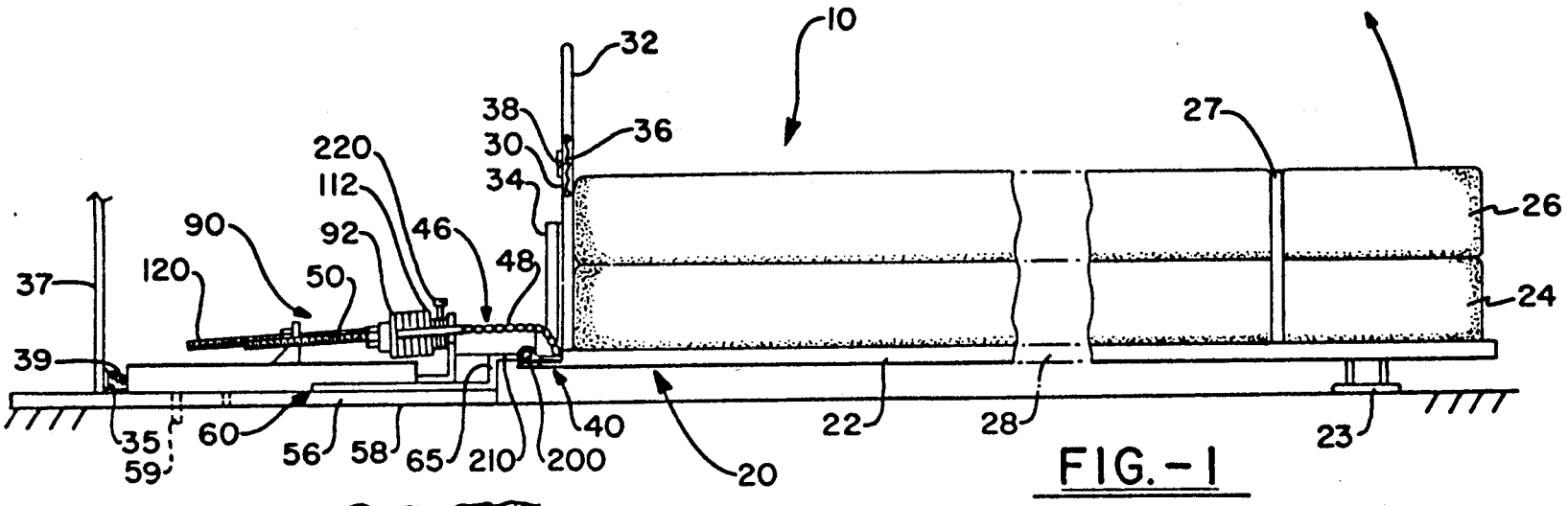
FIG. 1 shows a side view of a retractable bed assembly using the load repositioning device according to the present invention shown in the horizontal or lowered position.

The load repositioning device will now be described with reference to FIGS. 1 and 2 as used with retractable bed generally designated 10 which comprises a load frame generally 20, and a base 56 anchored to a surface or floor 58 by at least one of base anchoring bolt 59. Anchoring bolts 59 can be expansion bolts when base 56 is to be anchored to a concrete or cement floor or lag bolts in the case of a wooden floor. A spring support structure generally 60 is attached to the base 56 and supports a spring assembly generally 90. A plurality of hinges 200 are adapted to interconnect a plurality of lever means generally 40 attached to the frame 20 by means of a plurality of L-shaped end pieces 210 on the spring support structure 60 which allows load pivoting relative to the base 56. A plurality of adjustable load supports 220 are affixed to the spring support structure 60 and are adapted to engage the load frame 20 when said frame is in its vertical position so as to transfer the load's weight to the base 56 and thereby to the floor 58.

The frame 20 comprises an outer structure 22 which supports box springs 24 and a mattress 26. The frame 20 surrounds a base panel 28 and the mattress 26 and box spring 24 may be held in place by straps 27 which are anchored to frame 20 and surround mattress 26 and box spring 24. The outer structure 22 may be constructed of welded steel or other strong and durable building materials to provide strength to the frame 20. Base panel 28 is designed to make the bed more attractive in the upright position and to act as an anchor site for the lever means. Panel 28 can be made of a variety of materials including wood, plastic, metal, or an equivalent building material. Frame 20 further comprises a plurality of frame handles 23, which are used as handles for lowering the bed and secondly, as frame rests when the bed is in its horizontal position. Frame 20 also includes a back stop 30 upon which the box springs 22 and mattress 24 are supported while the bed is in the upright position and a swing board 32 attached to back stop 30 by a plurality of small hinges 38 as shown in FIG. 1. Back stop 30 and swing board 32, make up the headboard and head rest when the bed is in a horizontal position as shown in FIG. 1. Frame 20 further comprises a plurality of a back support members 34 attached to each lever means 40 by standard methods known in the art, such as welding, brazing or nuts and bolts. The swing board 32 includes a plurality of swing board spring members 36 attached to the swing board 32 and the back stop 30 to control and position the swing board 32. Also, a plurality of swing board support arms 37 are anchored to said base by an arm spring 39, one for each arm, which are attached to the base 56 by arm hinge 35.

Figure 6:
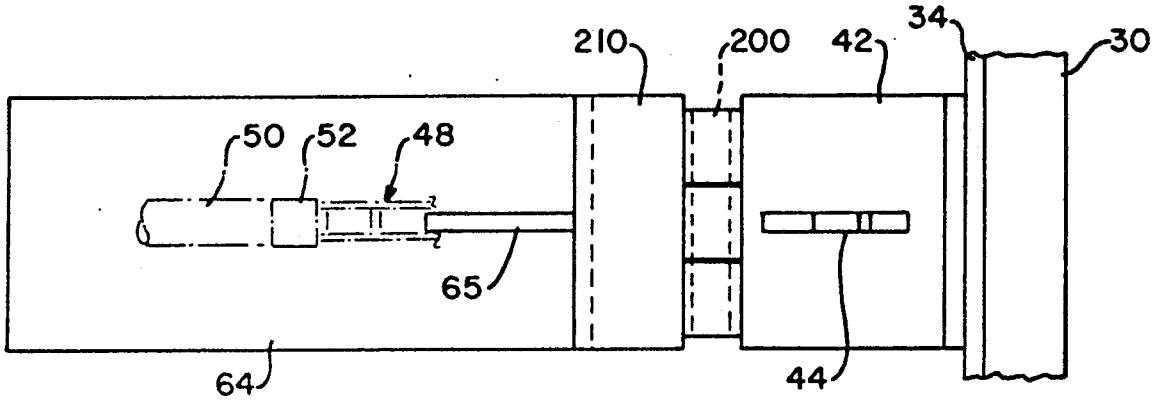
FIG. 6 shows an enlarged partially cut away close up top view of the chain and sprocket assembly connecting the spring and frame while the bed is in the horizontal position.
Figure 7:
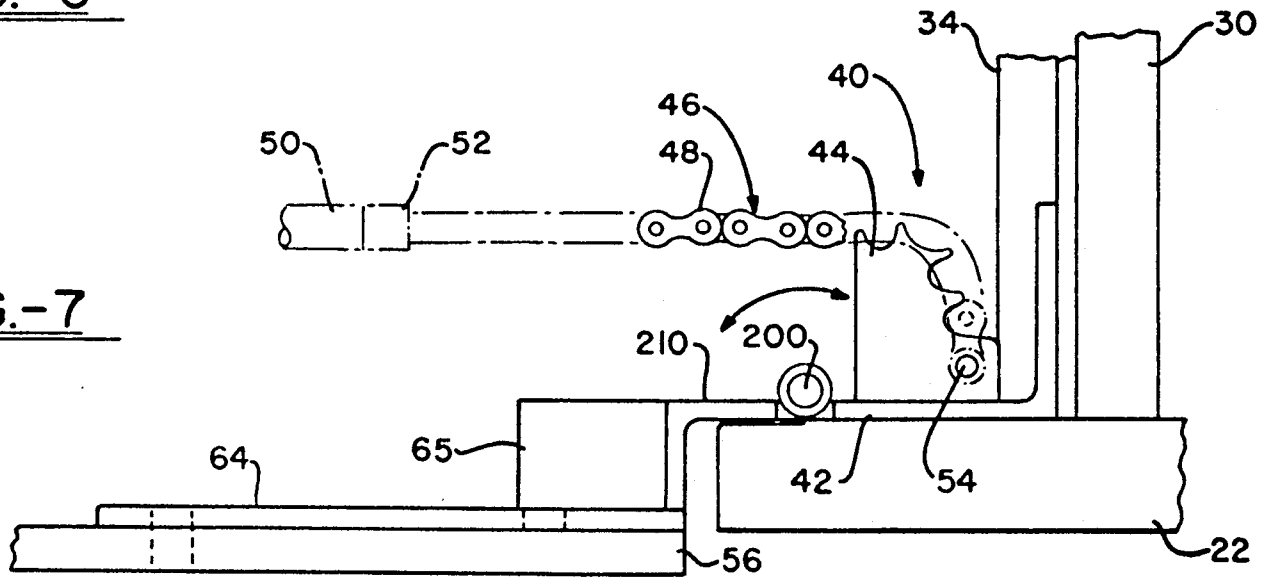
FIG. 7 shows an enlarged partially cutaway close up, side view of the chain and sprocket assembly connecting the spring and frame while the bed is in a horizontal position.

As shown more particularly in FIGS. 6 and 7, the plurality of lever means 40 comprises a support 42, one for each lever means, which are affixed to the frame 22 on the other side of the back stop 30 from the bed area. A roller chain sprocket 44, for each lever means is attached to support 42, and roller chain and rod assemblies 46, are adapted to engage the spring assembly 90 and sprocket 44. The roller chain and rod assemblies 46 comprise a roller chain segment 48 and a rod segment 50, wherein the chain segment 48 is affixed to the rod segment 50 at 52. The chain segment 48 is also attached to the support 42 at the base of sprockets 44 by a roller chain pin 54 or the like. It will be appreciated that other lever means such as a cam and cable assembly will work in an analogous fashion.

Figure 3:
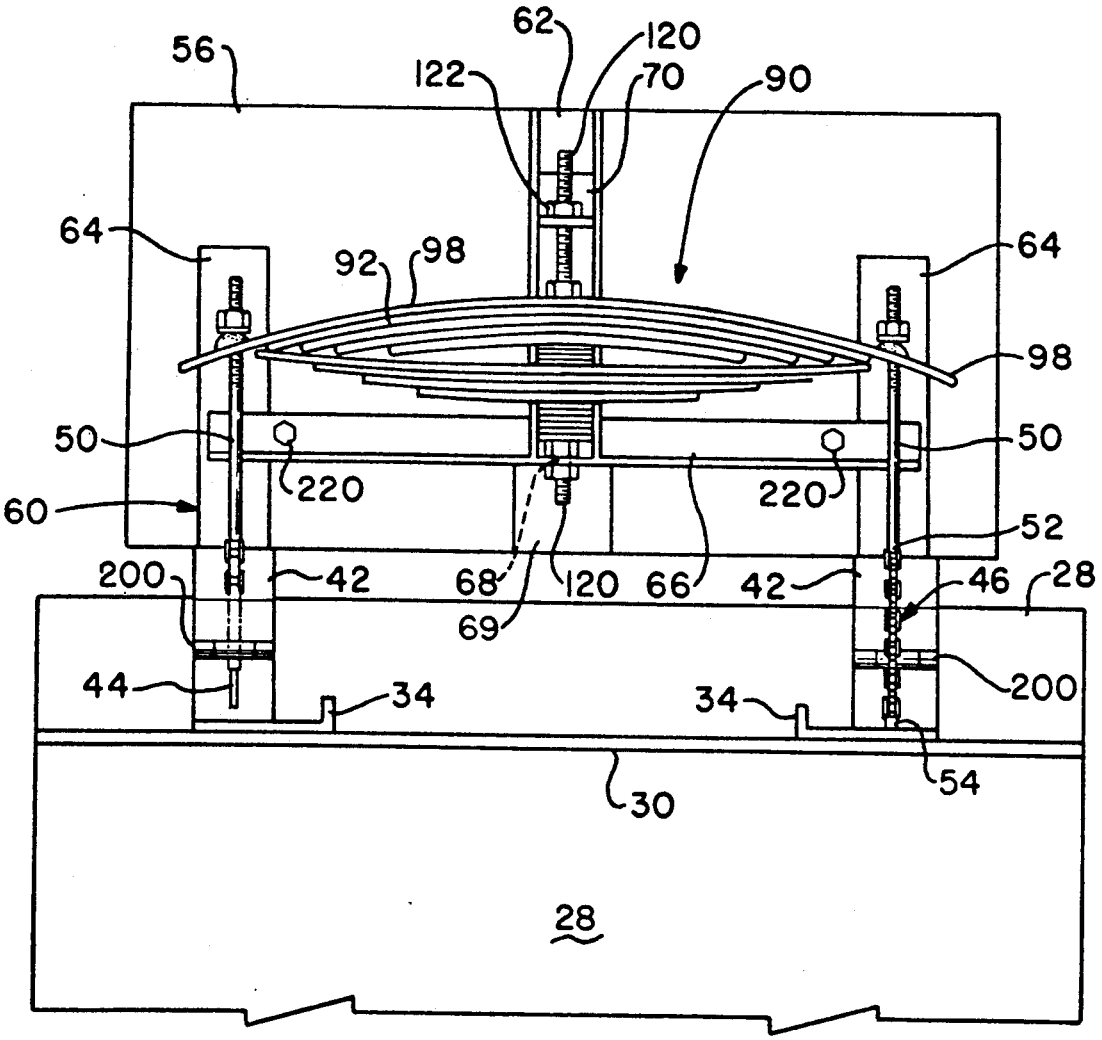
FIG. 3 shows close up, top view of the load repositioning device mounted on the base and partially cut away frame in the horizontal or down position.

The spring support structure 60 as seen in FIGS. 3–5 comprises: a center member 62, and two side members 64 being substantially parallel to center member 62 and positioned at an end closest to the bed frame. An L-shaped end piece 210 as seen in FIG. 7 is attached to side members 64 and a cleat 65 is attached to side member 64 and the L-shaped end piece 210. An L-shaped cross member 66 having an aperture 68 at a mid-portion thereof and a frame stop 69 attached at a center portion thereof is adapted to engage panel 28 when frame 20 is in a vertical position. The cross member 66 acts to interconnect center member 62 and side members 64. The center member 62 also supports a L-shaped rod mount 70 through an aperture therein. The center member 62, and side member 64 are affixed to cross member 66 by standard techniques such as welding or brazing. The L-shaped end piece 210 is inverted and adapted to engage said lever means. The cleat 65 is adapted to help support and position cross member 66. The entire spring support structure can be pre-fabricated out of a suitable building material such as metal or a high strength composite.

The spring assembly 90 in the preferred embodiment comprises a first set of leaf springs 92 and has an aperture 94 through a center region thereof and an aperture 96 at each end thereof going through the largest leaf 98 of spring set 92. A first spacer 100 which may comprise a plurality of plates having apertures 110 through a center region thereof, acts to separate spring 92 from a second smaller set of leaf springs 112 having an aperture 114 through a center portion thereof. A second spacer 116 comprising a plurality of plates having apertures 118 through a center region thereof, separate the spring 112 from cross member 66. A plurality of spring adjustment nuts 122 are adapted to allow spring and spacer adjustment, upgrade, downgrade or replacement. A threaded rod 120 is adapted at one end to engage the cross member 66 through aperture 68, and anchored by one of the adjustment nuts 122. Threaded rod 120 is further adapted at its other end to engage L-shaped rod mount 70 through aperture 72, anchored by a second adjustment nut 122. Rod 120 is also adapted to pass through leaf springs 92 and 112 to provide support and positioning of the springs. A third adjustment nut 122 is threaded onto rod 120 and tightened against spring 92 to maintain the position the spring set 92. The first spacer 100 is interposed between spring 92 and 112 to allow for proper positioning of spring 112 relative to spring 92. The second spacer 116 is interposed between the spring 112 and a fourth adjustment nut which is interposed between second spacer 116 and cross member 66 at aperture 68. The set of adjustment nuts 122 allows for efficient and flexible repositioning and tension adjusting of the springs to either increase or decrease the spring tension. The adjustment nuts 122 and the threaded rod 120 also provide a procedure for disassembling the spring assembly 90 in order to change the number of leaves in each spring set or the number of plates in each spacer. The number of leaves per spring will increase the tension and energy storage capacity of that leaf spring while increasing the number of plates will cause a increase in the tension by moving the relative position of springs 92 and 112.

Referring now to FIGS. 4–5, the operation of the load repositioning device will be described. In FIG. 5, when the bed is in a vertical position, the roller chain segments 48 are fully extended and not acted on by sprockets 44 and the leaf springs 92 and 112 are in their fully relaxed modes.

Figure 2:
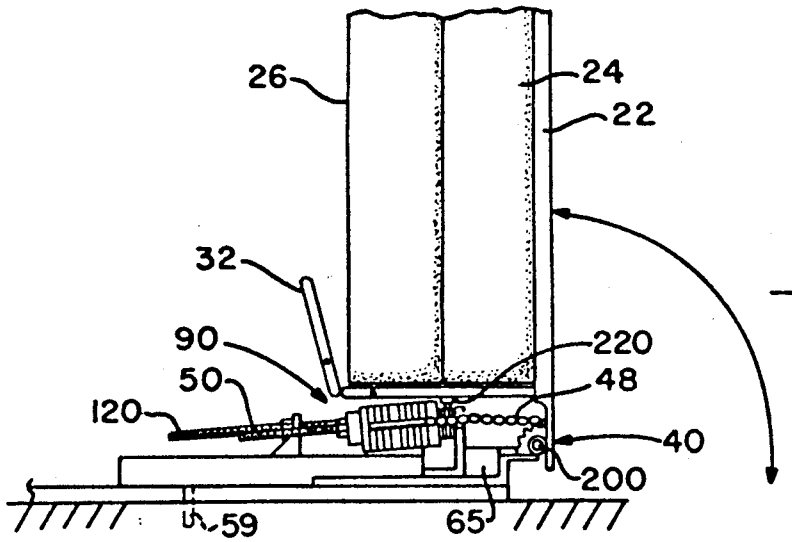
FIG. 2 shows a partially cut away side view of the retractable bed of FIG. 1 with the bed in the vertical or upright position.

When the bed is pulled downwardly to a position half way between the vertical position of FIG. 1 and the horizontal position of FIG. 2, the roller chain segments 48 are half way engaging the sprockets 44 so as to shorten the chain length, thereby imparting a force on the leaf spring 92 through rod segments 50. This action results in storage of energy in spring 92. This stored energy is converted into working energy when the reverse process of raising the bed is undertaken. The rod segments 50 are attached to leaf spring 92 through apertures 96 by standard fastening means such as a washer and nut. The deflection of leaf spring 92 is as yet insufficient to engage smaller springs 112.

When the bed is in a horizontal position as seen in FIG. 4, the roller chain segments 48 are fully engaging sprockets 44 so as to further shorten their length and impart the maximum pulling force on the leaf spring 92 such that the maximum energy is stored in spring 92. Leaf spring 92 is fully tensioned in the horizontal position as shown in FIG. 4 and is made to act on the smaller leaf spring 112 so as to force the spring 112 into tension having stored energy acting against spring 92. Smaller spring 112, is thus tensioned in the latter part of bed lowering. The energy stored by spring 112 assists bed raising during the first part of bed raising. Thus, the smaller spring 112 is designed to aid in the early stage of bed raising, which makes bed raising even easier especially when the bed is a large bed such as a queen or a king size bed.

From this description it should be recognized that the lowering of the bed acts to store energy in the pair of cooperation leaf springs. When raising of the bed is desired, the energy stored in the springs is translated into kinetic energy to facilitate raising of the bed both easily and smoothly. The roller chain and rod assemblies act to translate the stored energy of the springs by giving significant leverage advantages to the system. The apparatus provides a very effective and yet sturdy and durable design to facilitate retraction of a heavy load such as a bed from a horizontal to vertical position.

While in accordance with the patent statutes, a preferred embodiment and best mode has been presented, the scope of the invention is not limited thereto, but rather is measured by the scope of the attached claim.

What is claimed is:

1. A load repositioning device comprising:

(a) a load frame;

(b) a plurality of lever means attached to said frame;

(c) a base resting on a base support structure having a plurality of base anchor members adapted to engage the structure and anchor said base to said structure;

(d) at least one spring support structure mounted on the base;

(e) at least one spring assembly mounted on said spring support structure;

(f) wherein each of said plurality of lever means includes a hinge adapted to interconnect the lever means to said spring support structure allowing the load frame to rotate about said hinge relative to the base and wherein said lever means engages said spring assembly and exclusively rotational movement of said load frame relative to said base acts on said spring assembly through said lever means to impart a tensioning force thereto or to release stored energy therefrom to facilitate pivotal movement of said load frame.

2. A device according to claim 1, wherein said lever means comprises a sprocket support attached to the frame, a sprocket mounted on said support and a roller chain and rod assembly comprising a roller chain affixed to a threaded rod and attached to said support at a base position of said sprocket and adapted to engage said sprocket at a chain end portion and to engage said spring assembly at a rod end portion.

3. A device according to claim 1, wherein said spring support structure comprise a center member, two side members substantially parallel to the center member, a cross member having an aperture in a center region and disposed substantially perpendicular to said center and side members, an adjustable rod mount having an aperture and attached to said center member at an end furthest removed from said cross member, a plurality of adjustable load supports attached to said cross member and adapted to engage said load from when said frame is in the vertical or upright position, said cross member is adapted to engage said side members and center member such that the entire assemblage operates as one piece.

4. A device according to claim 1, wherein said spring assembly comprises:

(a) at least one leaf spring having an aperture at a center region therethrough and a plurality of end apertures through end regions of a largest leaf of a largest spring, said end apertures adapted to engage said lever means;

(b) at least one spacer having an aperture through a center region thereof and adapted to be interposed between the at least one spring and a cross member on said spring support structure to provide for spring tensioning and adjustment;

(c) a threaded rod adapted to engage said center apertures of said leaf spring and spacer, to engage at one end said center aperture of said cross member of said spring support structure and to engage at its other end an adjustable rod mount;

(d) a plurality of adjustment nuts threaded onto said rod to anchor said rod and to affix said spring and spacer on said rod in a predetermined position.

5. A retractable bed assembly for positioning the bed in a substantially horizontal position for use or a substantially vertical or upright position for storage, comprising:

(a) a bed frame;

(b) a plurality of lever means attached to said frame;

(c) a base resting on a base support structure having a plurality of base anchor members adapted to engage the structure and anchor said base to said structure;

(d) at least one spring support structure mounted on the base;

(e) at least one spring assembly mounted on said spring support structure;

(f) wherein each of said plurality of lever means includes a hinge adapted to interconnect the lever means to said spring support structure allowing the bed frame to rotate about the axis of said hinge relative to the base and wherein said lever means engages said spring assembly and exclusively rotational movement of said bed frame relative to said base acts on said spring assembly to impart a tensioning force thereto or to release stored energy therefrom to facilitate pivotal movement of said bed frame.

6. An assembly according to claim 5, wherein said lever means comprises a sprocket support attached to the frame, a sprocket mounted on said support and a roller chain and rod assembly comprising a roller chain affixed to a threaded rod and attached to said support at a base position of said sprocket and adapted to engage said sprocket at a chain end portion and to engage said spring assembly at a rod end portion.

7. An assembly according to claim 5, wherein said spring support structure comprise a center member, two side members substantially parallel to the center member, a cross member having an aperture in a center region and disposed substantially perpendicular to said center and side members, an adjustable rod mount having an aperture and attached to said center member at an end furthest removed from said cross member, a plurality of adjustable load supports attached to said cross member and adapted to engage said load from when said frame is in the vertical or upright position, said cross member is adapted to engage said side members and center member such that the entire assemblage operates as one piece.

8. An assembly according to claim 5, wherein said spring assembly comprises:

(a) at least one leaf spring having an aperture at a center region therethrough and a plurality of end apertures through end regions of a largest leaf of a largest spring, said end apertures adapted to engage said lever means;

(b) at least one spacer having an aperture through a center region thereof and adapted to be interposed between the at least one spring and a cross member on said spring support structure to provide for spring tensioning and adjustment;

(c) a threaded rod adapted to engage said center apertures of said leaf spring and spacer, to engage at one end said center aperture of said cross member of said spring support structure and to engage at its other end an adjustable rod mount;

(d) a plurality of adjustment nuts threaded onto said rod to anchor said rod and to affix said spring and spacer on said rod in a predetermined position.

9. An assembly according to claim 5, wherein said bed frame comprises:

(a) an outer structure supporting a box spring and a mattress and surrounding a panel;

(b) a strap attached to said frame anchoring said box spring and said mattress;

(c) a plurality of handles attached to said frame;

(d) a back stop anchored to said frame which acts as a head board;

(e) a swing board anchored to said back stop by a plurality of small hinges, said swing board acts as a head rest;

(f) a plurality of back stop support members attached to each lever means;

(g) a plurality of swing board spring members attacked to said swing board and said back stop; and (h) a plurality of swing board support arms anchored to said base by an arm spring and a arm hinge.

10. A load repositioning device comprising:

a load frame to carry and support a predetermined load, a base anchored to a surface, a plurality of lever means attached to said load frame and including means to allow said load frame to rotate about a predetermined axis relative to said base, at least one spring support structure attached to said base, at least one spring assembly supported on said spring support structure in a predetermined position and adapted to be engaged by said plurality of lever means such that pivoting of said load frame relative to said base about such predetermined axis will impart a tensioning force to said spring assembly to store energy therein or will release stored energy from said spring member to facilitate pivotal movement of said load frame relative to said base.

11. A load repositioning device as in claim 10, wherein, said plurality of lever means includes a support means having first and second portions which are engaged by hinge means to one another wherein said first portion is attached to said load frame and said second portion is attached to said base to allow said rotational movement of said load frame relative to said base about the axis of said hinge means, and includes a sprocket means attached to said first portion and a roller chain and rod assembly comprising a roller chain adapted to engage said sprocket and a rod portion adapted to engage said at least one spring assembly.

12. A load repositioning device according to claim 10, wherein, said at least one spring assembly is a leaf spring, said spring support structure includes at least a central member and a cross member positioned substantially perpendicular thereto, said center and cross members adapted to support and secure said leaf spring thereon in a predetermined position relative to said load frame, and wherein said spring support structure further includes an adjustable rod mount positioned on said center member and a threaded rod adapted to engage and position said leaf spring on said spring support structure at a center portion thereof and wherein said leaf spring is further engaged by said lever means at the end portions thereof.

13. The load repositioning device of claim 10, wherein, said at least one spring assembly includes at least one leaf spring secured to said spring support structure at a center portion thereof at a predetermined position relative to said load frame and said plurality of lever means are coupled to said leaf spring at end portions thereof such that upon pivotal movement of said load frame, said lever means will correspondingly act on said end portions of said leaf spring to impart said tensioning force to said leaf spring or to release stored energy from said leaf spring.

14. The load repositioning device of claim 13, wherein, said spring assembly includes a pair of cooperating leaf springs supported on said spring support structure at a center portion thereof and in a predetermined position relative to said load frame and positioned relative to one another by means of at least one spacer interposed therebetween, wherein a first of said cooperating pair of leaf springs is coupled to said plurality of lever means at end portions thereof such that, upon pivotal movement of said load frame said lever means will act upon said first leaf spring to impart said tensioning force thereto or to release stored energy therefrom, and wherein the second of said pair of cooperating leaf springs is positioned relative to said first leaf spring such that tensioning of said first leaf spring will act upon said second leaf spring to store additional energy therein to further facilitate pivotal movement of said load frame relative to said base.

15. The load repositioning device of claim 10, wherein, a plurality of spring assemblies and spring support structures are provided in spaced apart relation relative to said load frame to facilitate pivotal movement of said load frame relative to said base.

16. The load repositioning device of claim 10, wherein, said at least one spring assembly is a leaf spring and includes adjustment means to facilitate changing of the spring capacity of the leaf spring so as to accommodate different sized loads or to compensate for loss of original spring capacity due to aging.

* * * * *